United States Patent [19]

Head

[11] 4,116,761

[45] Sep. 26, 1978

[54] POROUS ELEMENT AND THE PREPARATION THEREOF

[75] Inventor: Brian Arthur Head, Maidstone, England

[73] Assignee: Whatman Reeve Angel Limited, Maidstone, England

[21] Appl. No.: 869,053

[22] Filed: Jan. 13, 1978

Related U.S. Application Data

[63] Continuation of Ser. No. 664,501, Mar. 8, 1976, abandoned, which is a continuation-in-part of Ser. No. 523,587, Nov. 14, 1974, Pat. No. 3,972,694, which is a continuation-in-part of Ser. No. 509,204, Sep. 25, 1974, abandoned.

[51] Int. Cl.[2] ..... D21F 11/00

[52] U.S. Cl. ..... 162/152; 162/181 B; 162/221; 162/222; 162/228; 210/509; 264/119

[58] Field of Search ..... 162/152, 181 B, 218, 162/221, 224, 228, 145, 222; 210/509; 264/87, 119, 294

[56] References Cited

U.S. PATENT DOCUMENTS

| | | | |
|---|---|---|---|
| 2,101,921 | 12/1937 | Shaver | 162/228 |
| 2,700,326 | 1/1955 | Curtis | 162/228 |
| 3,017,318 | 1/1962 | Labino et al. | 162/152 |
| 3,253,978 | 5/1966 | Bodendorf et al. | 162/152 |
| 3,262,578 | 7/1966 | Dennis | 210/509 |
| 3,943,032 | 3/1976 | Weaver | 162/152 |

FOREIGN PATENT DOCUMENTS

| | | | |
|---|---|---|---|
| 1,282,096 | 7/1972 | United Kingdom | 162/152 |

OTHER PUBLICATIONS

Calkin, "Modern Pulp & Papermaking" (1957) pp. 312, 313.

*Primary Examiner*—S. Leon Bashore
*Assistant Examiner*—Peter Chin
*Attorney, Agent, or Firm*—Richard P. Crowley

[57] ABSTRACT

A porous tubular element of uniform density and porosity is formed by uniformly depositing binder and crushable fibers selected from the group consisting essentially of polycrystalline, alumina, zirconia, aluminum silicate and potassium polytitanate fibers from an aqueous dispersion onto a cylindrical mold. The tubular element is then compressed with sufficient pressure to crush and rearrange the fibers to obtain uniform density and porosity.

30 Claims, No Drawings

POROUS ELEMENT AND THE PREPARATION THEREOF

This is a continuation of application Ser. No. 664,501, filed Mar. 8, 1976 abandoned; and which is a continuation in part of Ser. No. 523,587, filed Nov. 14, 1974 now U.S. Pat. No. 3,972,694; which is a continuation in part of Ser. No. 509,204, filed Sept. 25, 1974, abandoned.

The invention relates to a porous element and to a method of preparing a porous element. More particularly, the invention relates to the preparation of a uniformly porous element.

In accordance with the invention there is provided a method of making a porous element, which method comprises forming a homogeneous dispersion of crushable fibres as hereinafter defined having a diameter of from 0.001 to 10 microns in an aqueous medium, raising the pH of the dispersion, if necessary, to at least 7 and adding to the dispersion a colloidal solution of an inorganic bonding agent which is such that the bonding agent will be precipitated onto the fibres on the lowering of the pH of the dispersion, causing the fibres and colloid to be mutually dispersed, lowering the pH of the dispersion sufficiently to precipitate the bonding agent onto the fibres, forming a mat of interlaced fibres by uniform deposition from the dispersion, compressing the mat of fibres sufficient to break at least some of them and thereby provide a mat of uniform density, and drying the resulting mat of fibres.

By "crushable fibres" is meant fibres which when compressed in the form of a mat of interlaced fibres will break and undergo permanent rearrangement to provide a mat of uniform density. The suitability of any particular fibres can be readily determined by experiment. The brittleness of the fibres is considered to be an important factor governing their suitability and it may be advantageous for the fibres to be polycrystalline. Preferably, the fibres have a narrow range of fibre diameter.

It is apparent that borosilicate glass fibres conventionally employed in the manufacture of porous elements do not possess the required property of brittleness.

However, non-crushable fibres may be mixed with the crushable fibres provided that the uniform porosity of the porous element produced is not affected.

Suitable fibres may be selected from inorganic fibres such as alumina and zirconia fibres. Other inorganic fibres may be used such as aluminium silicate and potassium polytitanate.

Alumina fibres are particularly preferred. These may have a fibre diameter of from 1 to 5 mircons.

A particularly preferred alumina fibre is "Saffil" alumina fibre. ("Saffil" is a trade mark of Imperial Chemical Industries Limited for inorganic fibres). These preferred fibres have a uniform fine diameter, a circular cross-section and vary in length from about 2 cm to 5 cm with kinks at irregular intervals along their length. Individual fibres are polycrystalline and microporous. The fibres consist essentially of $Al_2O_3$ with other inorganic oxides and have a reactive surface which facilitate bonding to other materials such as refractory cements and organic resin e.g. phenolic resins, epoxy resins and polyolefins. Typical properties of the preferred alumina fibres are as follows:

Fibre density: 2.5 $gcm^{-3}$
Melting point: >2000° C.

Maximum use temperature: 1400° C.
Specific heat: 0.25 cal $g^{-10}C^{-1}$
Tensile strength: $1 \times 10^3$ MN $m^{-2}$
Specific tensile strength: $40 \times 10^3$m
Young's modulus: $1 \times 10^5 MNm^{-2}$
Specific modulus: $4 \times 10^6$m
Mean diameter: 3 microns
Surface area: 10 $m^2g^{-1}$
Hardness (MOH): 6

Preferably, a dilute dispersion of the alumina fibres is formed in an aqueous acidic solution having a pH of from 2.8 to 3.5, more preferably having a pH of about 3.

Before the inorganic bonding agent is added it is necessary to ensure that the pH of the dispersion is such that premature or uneven precipitation does not occur. The pH of the dispersion is preferably from 7 to 8.

The inorganic bonding agent may be added in an amount to provide from 5 to 40 percent solids on fibre w/w and more preferably in an amount to provide from 15 to 35 percent solids on fibre w/w. It may be beneficial to employ the inorganic bonding agent in an amount to provide about 25 percent solids on fibre w/w.

The inorganic bonding agent must be capable of providing a bond of inorganic material between the fibres when dried in contact with the fibres, with firing if necessary. Preferably, the inorganic bonding agent is an inorganic oxide. An inorganic oxide e.g. a silicate may be used. A preferred inorganic bonding agent is an alumina (boehmite) sol. Other suitable inorganic oxide bonding agents include silica and zirconia sols. The inorganic bonding agent may contain organic moities provided that these are removed in the drying operation. For example, an organo silicate such as a quaternary ammonium silicate may be employed since on firing the organic content is removed.

Once the colloid has been mutually dispersed with the fibres the pH of the dispersion is lowered to precipitate the colloid onto the fibres. In this way, the colloid is evenly precitated and becomes fixed to the fibres so that migration of the inorganic bonding agent during subsequent drying of the filter element is prevented. The pH of the dispersion may be lowered by the addition of aluminium sulphate solution. The pH is preferably lowered to a value of about 4.

The consistency of the dispersion of fibres and inorganic bonding agent is preferably from 0.1 to 0.5 percent.

The dispersion of fibres coated with the inorganic bonding agent is preferably drained by vacuum forming the fibres into a desired shape by immersing a porous mould into the dispersion and applying a vacuum to the mould. In a particular embodiment of the invention the fibres are formed into a hollow cylindrical shape on a cylindrical mould although it is to be appreciated that a variety of shapes may be produced e.g. a flat sheet. During vacuum forming the mould is preferably rotated to increase the eveness of the product.

For best results, it is necessary to deposit the fibres evenly on the mould and thus it is necessary for the flow of water through the mould to be very even. In a preferred embodiment of the invention, the mould comprises a stainless steel tube uniformly covered with drainage holes passing through the tube and the tube and holes are covered with a stainless steel wire cloth. The wire cloth is particularly advantageous for providing easy release of the mat of fibres which is not the case with, say, perforated metal. Preferably the tube is provided with a circumferential collar at each end of a section of the tube containing drainage holes and covered with the wire cloth. Preferably the mould is rotated about its longitudinal axis and a vacuum is applied at each end of the mould. It may be advantageous to apply a vacuum at intervals along the length of the tube.

In order to produce a cylindrical porous element free of wall thickness variations it is necessary for the external diameter of the stainless steel tube and the wall thickness of the collars to be such that the tube and collars are accurately circular and concentric. Also the wire cloth should be of even thickness.

As the pressure difference across the mould increases, the flow of water through the mould becomes more even. Higher pressure differences are preferred for this reason.

The mat of fibres deposited on the mould may be compressed sufficient to break at least some of the fibres and thereby provide a mat of uniform density by rolling the mould under pressure across a surface e.g. the surface of a wire-covered board.

The coated alumina fibres may be crushed and moulded into the desired shape without wrinkling and with little surface relief.

Once the coated fibres have been drained and, if necessary, shaped the fibres are dried. Heat may advantageously be applied to the fibres in order to dry them and the fibres are preferably dried at a temperature of from 90° to 110° C.

The dried fibre mat may be impregnated with a binder which provides a binding effect between the fibres without affecting the uniformity of porosity of the element. For example, the binder may be chosen so that the impregnated element is machinable e.g. the element may be successfully worked on a lathe.

Preferably binders are curable organic resins optionally containing a curing catalyst.

Preferably, the fibre mat is impregnated with a dilute solution of the resin, the solvent is evaporated and the resin is then cured.

A particularly preferred organic resin is a silicone resin. For example, I.C.I. silicone resin R 282 may be used which is a hard resin which can be mixed with other silicone resins if required. The resin has good hardness and heat life at temperatures up to 250° C. Typical properties of the R 282 are as follows:

Total solids: 60 ± 1
% silicone in total solids: 100
Solvents: Toluene
Viscosity centipoises (Brookfield) 25° C.: 50–100
Average S.G. (25° C.): 1.09
Flash Point Closed Cup: <10° C.

Other organic resins which may be used include epoxy resins.

The resin is preferably dissolved in an organic solvent to give a dilute solution. For example, a solution consisting of 5 percent by weight organic resin solids in a suitable organic solvent may be employed. Examples of solvents which may be employed are 1,1,1-trichloroethane, methyl ethyl ketone and toluene.

A catalyst is used to reduce curing times and improve heat life. The catalyst is preferably an oil soluble organo metallic compound, for example, zinc octoate, zinc naphthenate and dibutyl tin dilaurate. Zinc octoate is a particularly preferred catalyst for silicone resins. The resin is preferably heated when curing. For example, a silicone resin such as R 282 as hereinbefore described may be satisfactorily cured by heating at 200° C. for 1 hour.

In addition to curable organic resins, inorganic binders e.g. a silica binder, may be used.

In accordance with another aspect of the invention there is provided a uniformly porous element comprising a compressed mat of interlaced crushable fibres as hereinbefore defined having a diameter of from 0.001 to 10 microns, wherein the fibres are bonded together by an inorganic fibre coating. The bonded coated fibres may be further bonded together by a binder which renders the porous element machinable.

The porous elements of the invention have very uniform porosity and can be used to evenly dispense a liquid, gas or vapour. Further, the porous elements are capable of being accurately machined and can be used continuously at a temperature as high as e.g. 250° C. using an organic resin binder and at a higher temperature using an inorganic binder.

A major advantage of using the uniformly porous elements of the invention for filtration is that compared with non-uniformly porous elements greater efficiency is achieved for the same rate of flow of fluid through the element. The efficiency of the element improves with improved uniformity of porosity.

In accordance with another aspect of the invention there is provided a method of filtering or dispensing a fluid which method comprises passing the fluid through a porous element of the invention.

The porous elements of the invention have a variety of uses.

For example, the elements are of particular use for dissolving a gas or vapour in a liquid where it is beneficial for a large surface area of gas to be presented to the liquid. This requires a large number of small bubbles of the gas or vapour which in turn requires the dispensing element to have a large number of small pores evenly distributed in the surface of the element. One particular application of this kind is the aeration/ozonization of liquids e.g. in sewage treatment.

The elements of the invention are also valuable as gas diffusers where it is necessary for the gas to be diffused evenly. For example, a cylindrical element may be used to advantage for providing an even radial flow of air for cooling synthetic fibers as they are produced.

Further, an element of the invention may be used as a "wick" where it is necessary for the wicked liquid to rise evenly up the wick. In this connection the element may be used for chromatographic separation. For this application, an element of the invention formed from alumina fibres and an alumina binder is particularly useful. Further, the element may be impregnated with, say, uniform dispersion of finely divided silica gel to provide a chromatographic medium.

A specific embodiment of the invention is described in the following example.

EXAMPLE

A homogeneous dispersion of "Saffil" alumina fibres as hereinbefore described was prepared in an aqueous acidic solution having a pH of 3. The pH of the dispersion was raised to a value between 7 and 8 and sufficient alumina sol was added to provide 25 percent solids on fibre w/w. The alumina sol was mutually dispersed with the fibres and aluminium sulphate solution was added to lower the pH of the dispersion to 4 thereby precipitating the colloid on the fibres.

A cylindrical vacuum mould or forming mandrel was introduced into the dispersion. The mandrel comprised a stainless steel tube accurately machined to have an external diameter of 0.75 inch and an internal diameter of 0.5 inch. At each end, the tube was provided with a circumferential collar for determining the thickness of the finished fibrous elements. Each collar was accurately machined to a width of 0.107 inch. The length of the tube between the collars was 9 inches and this portion of the tube was uniformly covered with circular drainage holes each having a diameter of 0.125 inch, the centres of the holes being spaced 0.134 inch apart. The portion of the tube between the collars was covered with a narrow gauge stainless steel wire cloth wherein the seam was made by welding individual strands of wire to prevent non-uniformity of flow at the seam. The wire cloth had a mesh size of 60 mesh.

The tube was rotatably mounted and was connected to a vacuum source at each end. In operation, the tube was rotated and vacuum was applied to each end whereby the coated fibres in the dispersion were uniformly deposited on the surface of the wire cloth. The operation was continued until the fibre depth sufficiently exceeded the width of the collars.

The vacuum mould was then removed from the dispersion and excess liquid was removed from the mat of interlaced fibres formed on the mould by continuing the vacuum for a period of time. The surface of the mat of fibres was corrugated.

The mat of fibres was then compressed by rolling the mould over a wire-covered board. Rolling was continued until the thickness of the mat had been reduced to the width of the collars on the tube which prevented any further reduction in thickness and ensured that the mat of fibres in the form of a tube had a uniform thickness. The surface of the mat was now smooth with no trace of the corrugations originally present.

The tube of fibres so produced was dried by heating in an oven at a temperature of 100° C.

The dried tube was impregnated with a 5 percent by weight solution of I.C.I. slicone resin R 282 in 1,1,1-trichloroethane as solvent using zinc octoate as the curing catalyst. The impregnated tube was cured by heating for 1 hour at 200° C.

What I claim is:

1. A method of making a tubular element of uniform density and porosity which method comprises:

a. uniformly depositing onto the surface of a cylindrical porous mold from an aqueous dispersion of crushable fibres coated with a bonding agent, a tubular mat of the coated crushable fibres, the fibres of the aqueous dispersion consisting essentially of and selected from the group of polycrystalline fibres comprising alumina fibres, zirconia fibres, aluminum silicate fibres, and potassium polytitanate fibres which fibres have a diameter of from about 0.001 to about 10 microns, the mold substantially uniformly covered with drainage holes for the removal of excess water from the dispersion and having accurately circular and concentric circumferential collars of defined width at each end of the mold containing the drainage holes, the deposited tubular mat on the mold having a defined thickness which exceeds the width of said collars; and b. compressing the tubular mat of fibres while on said mold by rolling the mold on the said collars across a surface with sufficient pressure to reduce the width of the tubular mat to the width of the circumferential collars to crush and rearrange the fibres and provide a mat of essentially uniform density and porosity and with a substantially smooth external surface; and c. drying the resultant tubular mat of bonded and crushed fibres.

2. The method of claim 1 which includes depositing the crushable fibres onto the surface of the mold by immersing the mold in the said aqueous dispersion and rotating the mold on its longitudinal axis while applying a vacuum at each end of the mold.

3. The method of claim 2 which includes impregnating the dry tubular mat of bonded and crushed fibres with an additional binder which additional binder, after impregnation, does not substantially effect the uniformity or porosity of the tubular element.

4. The porous bonded impregnated tubular element produced by the method of claim 3.

5. A method of making a tubular element of uniform density and porosity which method comprises:

a. forming an homogeneous dispersion in an aqueous medium of crushable fibres, the fibres consisting essentially of and selected from a group of polycrystalline fibres comprising alumina fibres, zirconia fibres, aluminum silicate fibres, and potassium polytitanate fibres which fibres have a diameter of from about 0.001 to about 10 microns;

b. adding to the dispersion a colloidal solution of an inorganic bonding agent;

c. uniformly dispersing the fibres and the colloidal solution in the aqueous medium;

d. lowering the pH of the dispersion sufficiently to precipitate the inorganic bonding agent onto the dispersed fibres;

e. forming a porous tubular mat of interlaced crushable fibres by uniform deposition from the dispersion onto the surface of a cylindrical porous mold which mold is substantially uniformly covered with drainage holes for the removal of excess aqueous medium;

f. compressing the tubular mat of fibres while on the cylindrical mold with sufficient pressure to crush and rearrange the fibres to provide a mat of essentially uniform density and porosity with a substantially smooth external surface; and g. drying the resulting tubular mat of bonded and crushed fibres.

6. The method as claimed in claim 5 wherein the crushable fibres are alumina fibres of generally uniform diameter and circular cross-section, which alumina fibres vary in length from about 2 to 5 centimeters, and which fibres consist essentially of $Al_2O_3$.

7. The method of claim 5 wherein the inorganic bonding agent is an inorganic metal oxide.

8. The method as claimed in claim 5 wherein the fibres have a diameter of from about 0.001 to about 5 microns.

9. The method of claim 5 wherein a dilute dispersion of the fibres is formed in an aqueous acidic solution having a pH of from about 2.8 to 3.5.

10. The method as claimed in claim 5 wherein the pH of the dispersion immediately before the addition of the colloidal solution is from about 7 to 8.

11. The method of claim 5 wherein the inorganic bonding agent is added in an amount to provide from about 5 to 40% solids by weight on the fibre.

12. The method of claim 5 wherein the inorganic bonding agent is alumina sol.

13. The method of claim 5 wherein after the inorganic bonding agent has been added, the pH of the dispersion is lowered to a value of from about 3.5 to 4.8.

14. The method of claim 5 wherein the consistency of the dispersion of fibres and the inorganic bonding agent is from about 0.1 tpo 0.5%.

15. The method of claim 5 which includes immersing the cylindrical porous mold in the dispersion of fibres coated with the inorganic bonding agent and applying a vacuum to the interior of the mold so that a tubular mat of interlaced fibres of defined thickness is formed on the surface of the mold.

16. The method of claim 15 which includes rotating the mold about its longitudinal axis and applying a vacuum at each end of the mold so that a mat of interlaced fibres is uniformly deposited on the surface of the mold.

17. The method of claim 16 wherein the cylindrical mold comprises a stainless steel tube uniformly covered with drainage holes, the surface of the tube and the holes being covered with a stainless steel wire cloth.

18. The method of claim 5 wherein the porous mold contains accurately circular and concentric circumferential collars of defined width at each end of the mold containing the drainage holes.

19. The method of claim 18 wherein compressing of the tubular mat on the mold is accomplished by rolling the mold under pressure across a surface to reduce the width of the tubular mat formed on the surface of the mold to the width of the circumferential collars.

20. The method of claim 19 wherein the tubular mat on the mold is compressed by rolling the mandrel across a wire covered board surface.

21. The method of claim 5 includes the step of impregnating the dried tubular matter fibres with an additional binder which binds the fibres together, which additional binder does not effect substantially the uniformity or porosity of the tubular porous element.

22. The method of claim 21 wherein the additional binder is a heat curable organic resin.

23. The method of claim 22 wherein the curable organic resin is a silicone resin.

24. The porous tubular element produced by the method of claim 5.

25. The porous bonded tubular element produced by the method of claim 21.

26. A method of making a porous tubular element having uniform density and porosity which method comprises:

a. forming an homogeneous dispersion in an acqueous medium of crushable fibres, the fibres consisting essentially of and selected from a group of polycrystalline fibres comprising alumina fibres, zirconia fibres, aluminum silicate fibres, and potassium polytitanate fibres which fibres have a diameter of from about 0.001 to about 10 microns;

b. adjusting the pH in the dispersion to a pH of from about 7 to 8;

c. adding to the dispersion a colloidal solution of a metal oxide bonding agent such that the metal oxide bonding agent precipitates onto the fibres on lowering of the pH of the dispersion, and dispersing uniformly the fibres in the colloidal solution of the metal oxide in the dispersion;

d. lowering the pH of the dispersion of an acidic pH sufficient to precipitate the metal oxide onto the dispersed fibres;

e. forming a tubular mat of interlaced fibres by uniform deposition onto the surface of a cylindrical vacuum mold which cylindrical mold is substantially uniformly covered with drainage holes and which mold contains accurately circular and conentric circumferential collars of defined width at each end of the mold containing the drainage holes and immersing the mold into the dispersion of the coated fibres and rotating the mold about its longitudinal axis while a vacuum is applied at each end, and forming a tubular mat of interlaced fibres on the surface of the mold with the tubular mat depth exceeding the width of the collars;

f. compressing the interlaced tubular mat of fibres on the mold by rolling the mold on its collar on a flat surface with sufficient rolling pressure to reduce the width of the interlaced tubular mat on the surface of the mold to the width of the collars and to form a smooth external surface of the mat on the mold; the rolling pressure crushing and rearranging the fibres to provide a tubular mat of uniform density and porosity; and g. drying the resulting compressed tubular mat of fibres to provide a porous tubular element.

27. The method of claim 26 which includes the step of impregnating the dried tubular mat of crushed fibres with an additional bonding agent without effecting substantially the uniformity or porosity of the dried crushed tubular element.

28. The method of claim 27 wherein the additional bonding agent comprises an organic resin.

29. The porous tubular element produced by the method of claim 26.

30. The porous bonded tubular element produced by the method of claim 28.

* * * * *